US008714072B1

(12) United States Patent
Villarreal

(10) Patent No.: US 8,714,072 B1
(45) Date of Patent: May 6, 2014

(54) ADJUSTABLE GUIDING DEVICE

(71) Applicant: Gilberto Villarreal, Oakland Township, MI (US)

(72) Inventor: Gilberto Villarreal, Oakland Township, MI (US)

( * ) Notice: Subject to any disclaimer, the term of this patent is extended or adjusted under 35 U.S.C. 154(b) by 0 days.

(21) Appl. No.: 13/858,070

(22) Filed: Apr. 7, 2013

(51) Int. Cl.
*F41G 3/16* (2006.01)
*F41G 3/26* (2006.01)

(52) U.S. Cl.
CPC ..... *F41G 3/165* (2013.01); *F41G 3/2633* (2013.01)
USPC ..... 89/41.05; 42/130

(58) Field of Classification Search
CPC ..... F41A 3/147; F41A 3/16; F41A 3/165; F41G 3/2627; F41G 3/2633; F41G 3/147; F41G 3/16; F41G 3/165
USPC ..... 42/114, 115, 116, 117, 130, 131; 89/41.05, 41.06
See application file for complete search history.

(56) References Cited

U.S. PATENT DOCUMENTS

| | | | | |
|---|---|---|---|---|
| 4,524,675 | A * | 6/1985 | Durenec et al. | 89/41.06 |
| 5,903,996 | A * | 5/1999 | Morley | 42/115 |
| 2011/0061283 | A1 * | 3/2011 | Cavallo et al. | 42/72 |

* cited by examiner

*Primary Examiner* — Stephen M Johnson
(74) *Attorney, Agent, or Firm* — Inventa Capital PLC

(57) ABSTRACT

An adjustable guiding device (the device) is used for a weapon for guiding a target. The device uses the slide-on rail of a gun for attachment purposes. A small digital camera is housed in an aiming module of the device to transmit a video of the target to a LCD screen sitting eye level. The LCD screen is attached to the module several support elements that envelope the barrel of the gun and slide. In addition to the digital camera, the module houses movable lenses for magnification/zoom function as well as a night vision capability to provide visibility of the target in dark environments.

14 Claims, 3 Drawing Sheets

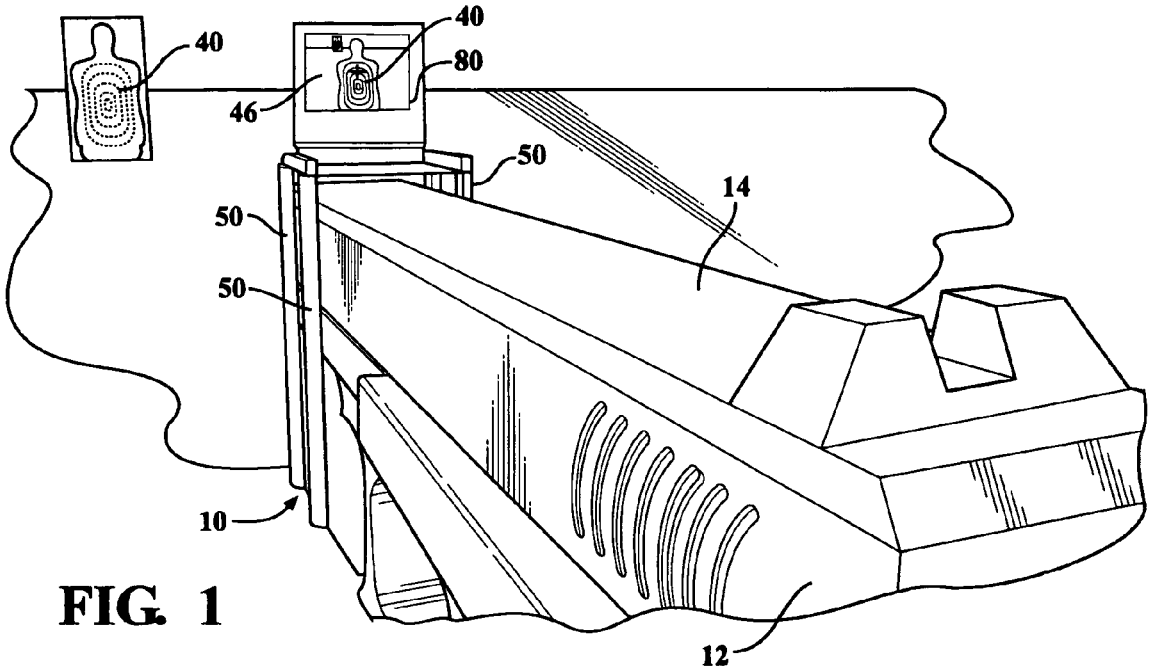
FIG. 1
FIG. 2
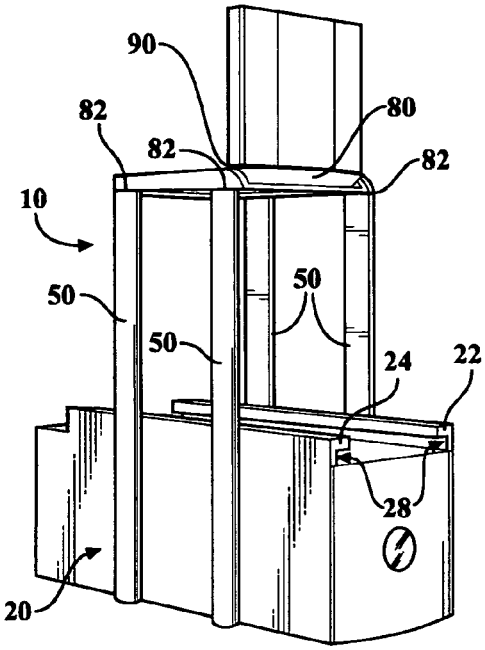
FIG. 3
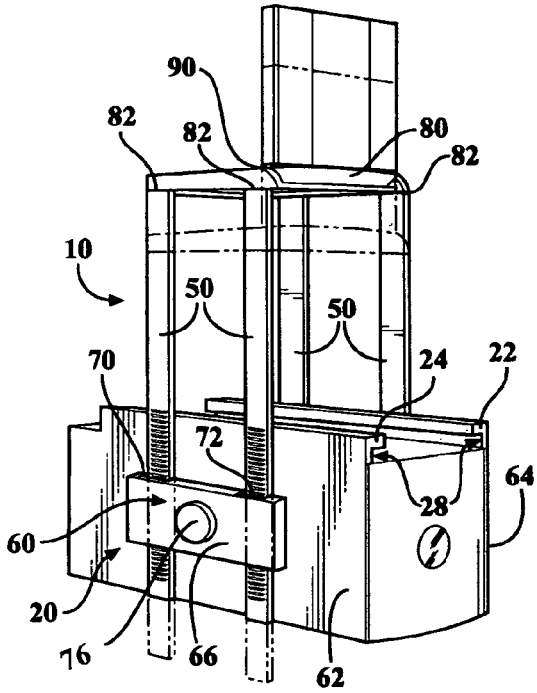

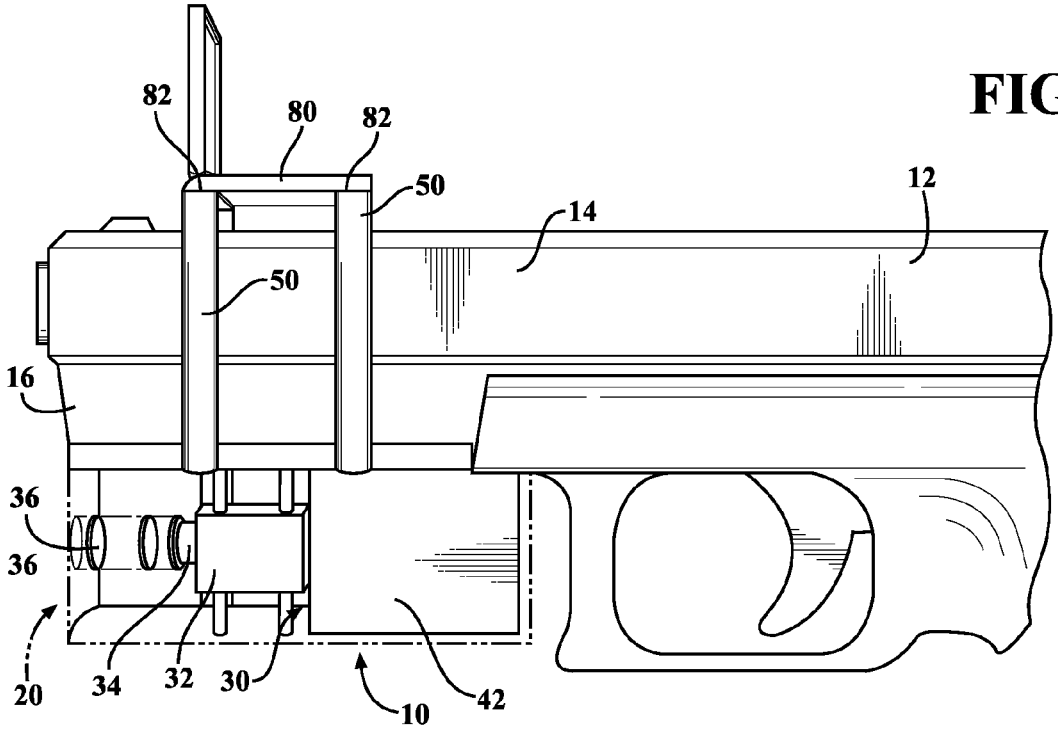
FIG. 6
FIG. 7
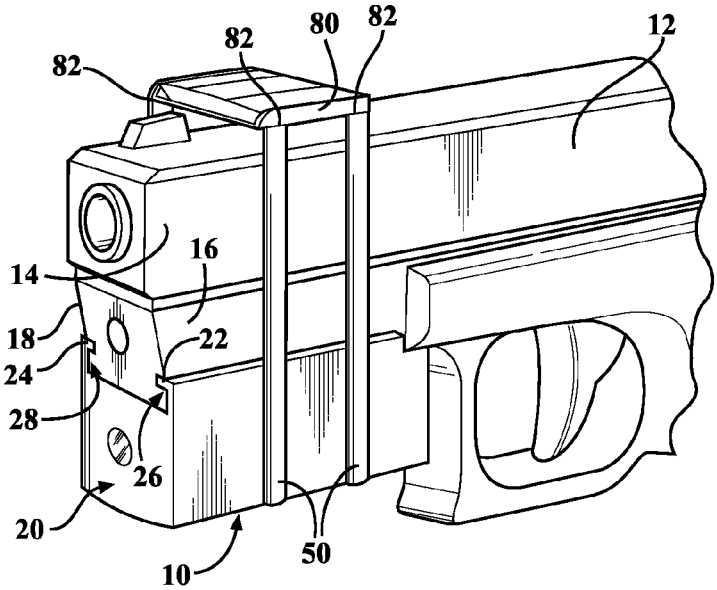

ADJUSTABLE GUIDING DEVICE

FIELD OF THE INVENTION

The present invention pertains to a targeting apparatus such as a guiding device.

BACKGROUND OF THE INVENTION

Today, people hunt animals for food and sport. The overall sport of hunting has increased in popularity because of the challenge and enjoyment of outdoor life and has become a major industry in the United States. Some hunters or naturalists will just walk through the forest; however, this limits the wildlife they will see due to either noise or visualization due to vegetation or simple because of a distance between the hunter and the target. A weapon such as a rifle is typically used in hunting. The weapon is aimed at long distances by use of a telescopic sight. Such a sight includes horizontal and vertical cross-hairs to provide aiming of the rifle toward the target. It is well known that if the target is located at greater distances from the rifle, the rifle angle above horizontal must be increased to compensate for the vertical drop by the projectile during its flight from the rifle to the target.

There have been numerous techniques proposed for adjusting rifle elevation as a function of the distance to the target. However, these various techniques are not fully successful in providing rapid, accurate and automatic elevation compensation for the aiming of a rifle toward a target. The art is replete with various other prior art references disclosing different prior art guiding devices.

U.S. Pat. No. 4,695,161 to Reed, for example, teaches an auto-ranging sight that includes an optical viewer that includes a reticle within the viewer. The reticle is a liquid crystal display having a plurality of horizontal lines which can individually be selected to be visible. A distance measuring device is provided for measuring distance from the sight to a target. Parameter information is input to a microprocessor to describe the flight of a projectile. The microprocessor also receives the distance information. The microprocessor then determines the required elevation for the optical viewer and attached weapon. It then selects one of the horizontal lines as the visible horizontal cross-hair. The operator then aligns the horizontal and vertical cross-hairs seen through the viewer such that the projectile can be accurately directed to the target. Optionally, a group of liquid crystal display vertical lines can be provided to accommodate windage adjustment for aiming the target. The range determination can be provided by systems using radar, laser, ultrasonic or infrared signals.

Another prior art reference, such as U.S. Pat. No. 6,199,286 to Reed et al., teaches an apparatus for the laser guidance of the aiming function used by the shooter, and fiber optics to increase the usability of the weapon. One type of adjustment is provided by a vertically movable and vertically adjustable cam member; and a second adjustment is provided through arm linkage which adjusts a rotatable laser holding member. Further features are the provision of a novel adjustable base means to adjust the laser for horizontal (windage) adjustment and also provided a standard of testing feature for testing vertical alignment. Fiber optics gives the shooter the means by which he is able to aim and shoot at farther targets in comparison to the lasers' limits of rangeability; and this fiber optic feature supplements the laser feature of the sight device, and the sight provides a novel sight pin feature.

Alluding to the above, United States Patent Publication No. 20110185619 to Finnegan et al., teaches a laser aiming device incorporated into a battery cap housing, which is in turn secured to such as an existing gun sight and which is in communication with the sights primary power source, such as a battery. The laser aiming device constitutes such as a diode and adjustment mechanism attached to a weapon sight battery source and, by virtue of a circuit closing cap insert, powering itself off the same.

Still another prior art reference, United States Patent Publication No. 20080184609 to Schulst, teaches a rear sight for a handheld weapon. The rear sight includes a tubular device that includes a tubular member comprising a material capable of transmitting visible light so that a target may be viewed through the tubular member, the tubular device, when mounted on a weapon, having at least two circle-like images at different locations along the length thereof that are visible when aiming the weapon on which the sight is mounted at a target by viewing the target through the tubular member. When aiming the weapon, a user will look through the tubular member towards the target and for proper alignment with respect to the target, will maneuver the weapon until the circle-like images are concentrically disposed.

The opportunity exist for a new design of a guiding device that is simple in manufacturing and operation and can be quickly engaged with a weapon to perform guiding functions in low light and bright light conditions and at variable distances.

SUMMARY OF THE INVENTION

An adjustable guiding device (the device) is used for a weapon, such as for example a handgun, for guiding a target. The device includes a module presenting a pair of rails used to engage with a slide-on rail of the handgun for attachment purposes. A battery, such as, for example a lithium ion battery is housed in the module. A small digital camera with a pair lenses for magnification is housed in the module of the device to transmit a video of the target to a LCD screen sitting eye level. The lenses are movable lenses and are also used for magnification/zoom function as well as a night vision capability to provide visibility of the target in dark environments.

Alluding to the above, a pair of cross hairs or lines are superimposed on the image of the target for aiming accuracy. A plurality of elements such as bars, struts, connectors, extend from the module at both sides of the module to further secure the module to the handgun. The LCD screen is attached to the module by the elements that envelope the barrel of the handgun and allow the barrel to slide back and forth as the shooting occurs.

In alternative embodiment of the present invention, the module includes an extension mechanism that allows for the elements to be moved beyond the module at variable distances to adapt the device to handguns of any types.

Another advantage of the present invention is to provide a new design of a guiding device that is simple in manufacturing and operation and can be quickly engaged with the weapon to perform guiding functions in low light and bright light conditions.

Still another advantage of the present invention is to provide an improved guiding device with the extension mechanism that adjusts the guiding device to handguns of various types.

Other objects, features, and advantages of the present invention will become apparent upon consideration of the following detailed description of a preferred embodiment thereof, when taken in conjunction with the appended drawing.

BRIEF DESCRIPTION OF THE DRAWINGS

Other advantages of the present invention will be readily appreciated as the same becomes better understood by reference to the following detailed description when considered in connection with the accompanying drawings wherein:

FIG. 1 illustrates a fragmental and perspective view of a handgun taken from a rear side with a guiding device installed thereon;

FIG. 2 illustrates a perspective view of the guiding device;

FIG. 3 illustrates a perspective view of alternative embodiment of the guiding device;

FIG. 6 illustrates a fragmental and a partially cross sectional view of the handgun with the guiding device of FIG. 4 wherein a screen is in its operating, i.e. guiding position; and FIG. 7 illustrates another perspective and partial view of yet another alternative embodiment of the guiding device the screen in its folded position.

DESCRIPTION OF THE INVENTION

Figure 4:
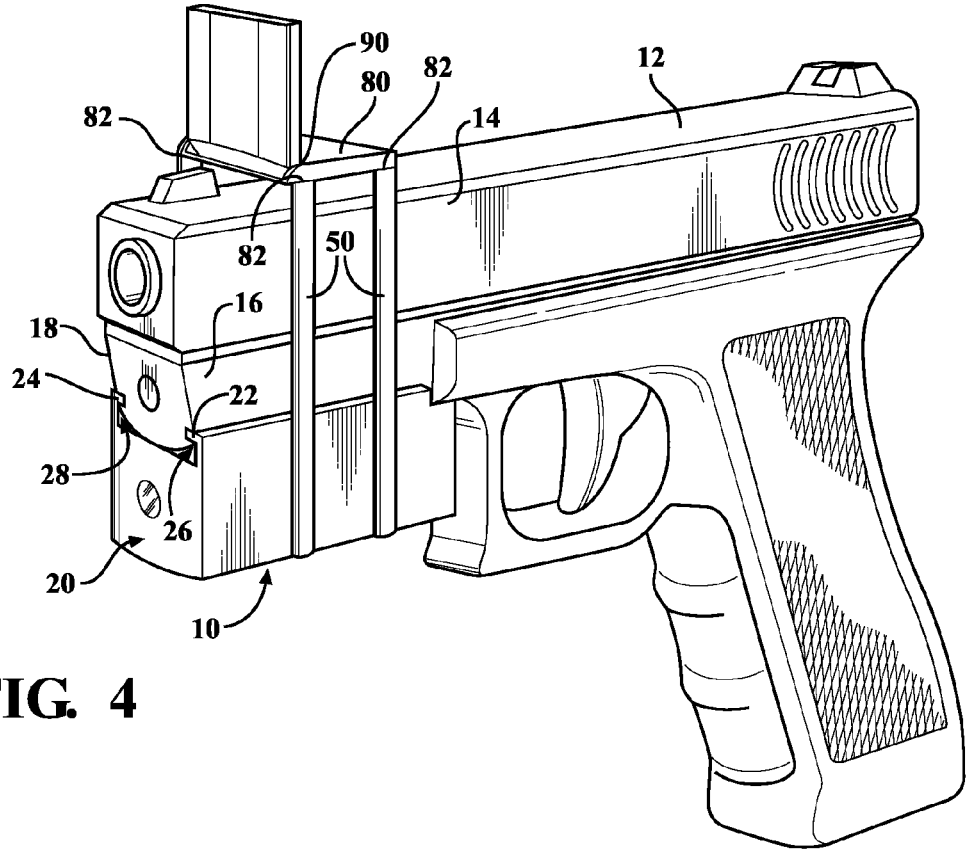
FIG. 4 illustrates a perspective view of the handgun with the guiding device installed thereon wherein a screen is in its operating, i.e. guiding position.
Figure 5:
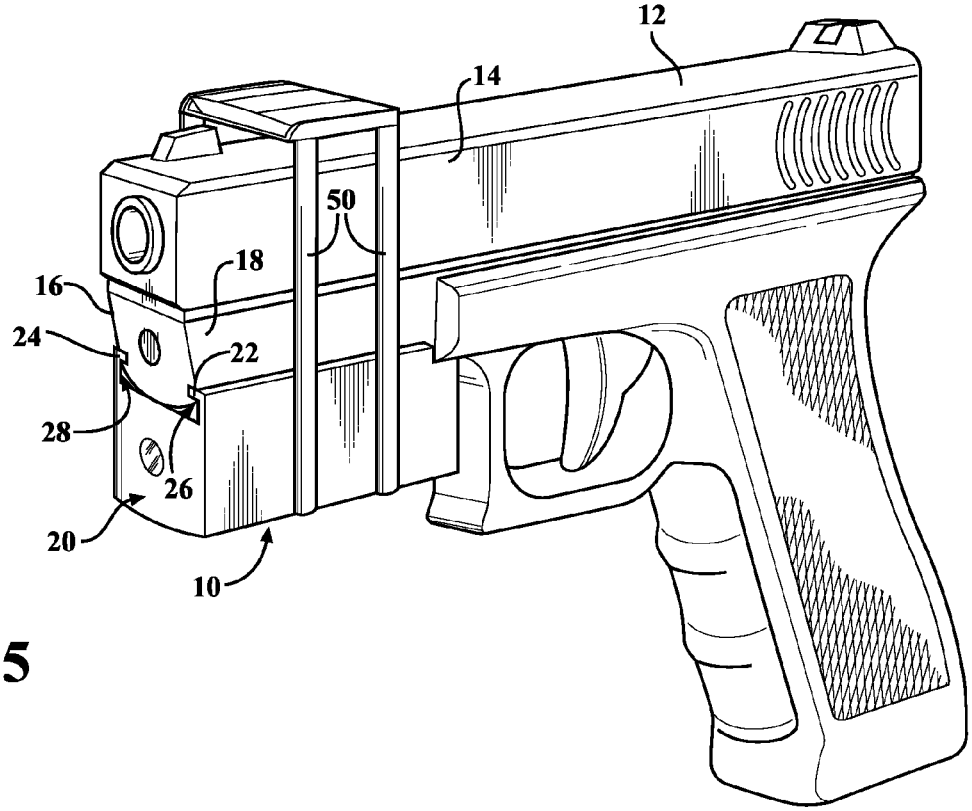
FIG. 5 illustrates a perspective view of the handgun with the guiding device installed thereon with the screen in its folded position.

Referring to FIGS. 1 through 7, wherein like numerals indicate like or corresponding parts throughout the several views, an apparatus of the present invention such as an adjustable guiding device (the device), is generally shown at 10. The device 10 allows a user to connect the device 10 to a handgun 12 having a barrel 14 and side surfaces 16 and 18 with tracks with the barrel 14 movable relative the side surfaces 16 and 18 in discharge mode of the handgun 12. The device 10 includes a housing or a module, generally indicated at 20, presenting male connectors 22 and 24 to engage with the side surfaces 16 and 18 of the handgun 12 thereby allowing the user to slide the housing 20 along the side surfaces 16 and 18. The male connectors 22 and 24 are further defined by rails, generally indicated at 26 and 28 extending from the housing 20 and presenting terminal ends having L-shaped cross.

The device 10 includes an aiming assembly, generally indicated at 30 in FIG. 6, included in the housing 20 and positioned within the housing 20. The assembly 30 includes a controller 32 with a digital camera 34 and magnifying lenses 36 for computing image of the target 40. A battery 42, such as, for example a lithium ion battery, is located in the housing 20. The digital camera 34 with the pair lenses for magnification is used to transmit a video of the target 40 to a LCD screen 46 sitting eye level. The lenses 36 are movable lenses and also used for magnification/zoom function to improve visibility of the target in dark environments. As best shown in FIG. 1, a pair of cross hairs or lines are superimposed on the image of the target 40 for aiming accuracy.

Alluding to the above, a plurality of elements 50 such as bars, struts, connectors, extend from the module 20 at both sides of the module 20 to further secure the module 20 to the handgun 12. The elements 50 present at least one of a circular cross section and a non-circular cross section. The LCD screen 46 is attached to the module 20 by the elements 50 that envelope the barrel 14 of the handgun 12 and allow the barrel 14 to slide back and forth as the shooting occurs. As connected to the housing 20, the elements support the LCD screen 46 with these elements 50 forming a frame to envelop the barrel 14 and the side surfaces 16 and 18 of the handgun 12 thereby allowing the barrel 14 to move relative the elements 50 and the housing 20.

As best shown in FIG. 3, a mechanical device, generally indicated at 60, is connected to the sides 62 and 64 of the housing 20. The mechanical device 60 including a pair of plates 66 and 68 are each connected to each of the sides 62 and 64 of the housing 20. Each of said plates defines at least one keyway 70 and 72 to receive each of the elements 50 moving through the keyways 70. Each of the plates 66 and 68 includes a button 76 movable in activated mode and a stopping mode thereby allowing the user to fix the travel distance of the elements 50 relative the housing 20.

A platform 80 is connected to terminal ends 82 of the elements 50 to support the screen 46. The LCD screen 46 is adjustable relative the housing 20 and the barrel 14 as the elements 50 are moved to and away from the housing 20 at various distances. The LCD screen 46 is pivotably connected to said platform 80 to fold the LCD screen 46 to coplanar with the platform 80 when said adjustable guiding device 10 is in idle mode and away in substantially perpendicular form as the device 10 is in its operational mode.

The housing 20 and the elements 50 are fabricated from at least one of a polymeric material and a non-polymeric material without limiting the scope of the present invention. The housing 20 and the elements 50 are injection molded and stamped without limiting the scope of the present invention.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An adjustable guiding device allowing a user to connect the adjustable guiding device to a handgun having a barrel and side surfaces with tracks with the barrel movable relative the side surfaces in discharge mode of the handgun, said adjustable guiding device comprising;

a housing presenting male connectors to engage with the side surfaces of the handgun thereby allowing the user to slide said housing along the side surfaces;

an aiming assembly positioned within said housing and presenting a controller with a digital camera and magnifying lenses for computing image of a target; and a plurality of elements connected to said housing and supporting a screen with said elements forming a frame to envelop the barrel and the side surfaces of the handgun thereby allowing the barrel to move relative said elements and said housing.

2. An adjustable guiding device as set forth in claim 1, including a mechanical device connected to sides of said housing, said mechanical device including a pair of plates each connected to each of said sides of said housing, each of said plates defining at least one keyway to receive each of said elements moving through said keyways.

3. An adjustable guiding device as set forth in claim 2, wherein each of said plates includes a button movable in activated mode and a stopping mode thereby allowing the user to fix the travel distance of said elements relative said housing.

4. An adjustable guiding device as set forth in claim 3, including a platform connected to terminal ends of said elements to support said screen, said screen being adjustable relative said housing and the barrel as said elements are moved to and away from said housing at various distances.

5. An adjustable guiding device as set forth in claim 4, wherein said screen is pivotably connected to said platform to fold said screen to coplanar with said platform when said adjustable guiding device is in idle mode and away in substantially perpendicular form as said adjustable guiding device is in its operational mode.

6. An adjustable guiding device as set forth in claim 1, wherein said elements present a circular cross section.

7. An adjustable guiding device as set forth in claim 1, wherein said elements present a non-circular cross section.

8. An adjustable guiding device as set forth in claim 1, wherein said mail connectors are further define by rails extending from said housing and presenting terminal ends having L-shaped cross section.

9. An adjustable guiding device as set forth in claim 1, wherein said housing and said elements are fabricated from a polymeric material.

10. An adjustable guiding device as set forth in claim 1, wherein said housing and said elements are fabricated from a non-polymeric material.

11. An adjustable guiding device as set forth in claim 1, wherein said housing and said elements are injection molded.

12. An adjustable guiding device allowing a user to connect the adjustable guiding device to a handgun having a barrel and side surfaces with tracks with the barrel movable relative the side surfaces in discharge mode of the handgun, said adjustable guiding device comprising;

a housing presenting male connectors to engage with the side surfaces of the handgun thereby allowing the user to slide said housing along the side surfaces, said male connectors are further define by rails extending from said housing and presenting terminal ends having L-shaped cross section;

an aiming assembly positioned within said housing and presenting a controller with a digital camera and magnifying lenses for computing image of a target; and a plurality of elements connected to said housing and supporting a screen with said elements forming a frame to envelop the barrel and the side surfaces of the handgun thereby allowing the barrel to move relative said elements and said housing;

a mechanical device connected to sides of said housing, said mechanical device including a pair of plates each connected to each of said sides of said housing, each of said plates defining at least one keyway to receive each of said elements moving through said keyways, wherein each of said plates includes a button movable in activated mode and a stopping mode thereby allowing the user to fix the travel distance of said elements relative said housing; and a platform connected to terminal ends of said elements to support said screen, said screen being adjustable relative said housing and the barrel as said elements are moved to and away from said housing at various distances, wherein said screen is pivotably connected to said platform to fold said screen to coplanar with said platform when said adjustable guiding device is in idle mode and away in substantially perpendicular form as said adjustable guiding device is in its operational mode.

13. An adjustable guiding device as set forth in claim 12, wherein said elements present at least one of a circular cross section and a non-circular cross section.

14. An adjustable guiding device as set forth in claim 12, wherein said housing and said elements are fabricated from at least one of a polymeric material and a non-polymeric material.

* * * * *